US006165603A

United States Patent [19]

Girardot et al.

[11] Patent Number: 6,165,603

[45] **Date of Patent: *Dec. 26, 2000**

[54] WASHING IMPLEMENT COMPRISING AN IMPROVED OPEN CELL MESH

[75] Inventors: Richard M. Girardot, Cincinnati; Gene M. Altonen, West Chester; Lyle B. Tuthill, Indian Hill, all of Ohio

[73] Assignee: Procter & Gamble Company, Cincinnati, Ohio

[ * ] Notice: This patent is subject to a terminal disclaimer.

[21] Appl. No.: 08/695,253

[22] Filed: Aug. 8, 1996

Related U.S. Application Data

[63] Continuation-in-part of application No. 08/631,861, Apr. 12, 1996, abandoned.

[51] Int. Cl.[7] ..... A47K 7/02; A47K 7/04; B32B 5/02

[52] U.S. Cl. ..... 428/219; 442/1; 442/50; 15/208

[58] Field of Search ..... 442/50, 1, 41; 428/131, 136, 219; 15/208

[56] References Cited

U.S. PATENT DOCUMENTS

| | | | |
|---|---|---|---|
| 1,533,868 | 4/1925 | Kingman | 15/229.1 |
| 1,659,977 | 2/1928 | Kingman | 15/208 |
| 1,689,207 | 10/1928 | Kingman | 15/229.1 |
| 1,794,854 | 3/1931 | Kean | 15/229.1 |
| 1,865,785 | 7/1932 | Parker | 15/209.1 |
| 1,963,529 | 6/1934 | Protz | 15/208 |
| 2,006,708 | 7/1935 | Benedict | 15/208 |
| 2,151,448 | 3/1939 | Steinberg | 2/158 |
| 2,601,771 | 7/1952 | Cameron | 66/170 |
| 2,857,610 | 10/1958 | Rympalski | 15/209 |
| 2,940,100 | 6/1960 | Grossmeyer | 15/118 |
| 3,169,264 | 2/1965 | Walker | 15/118 |
| 3,241,171 | 3/1966 | Benjamin et al. | 15/118 |
| 3,711,889 | 1/1973 | Jennings | 15/227 |
| 3,772,728 | 11/1973 | Johnson | 15/209 R |
| 3,778,172 | 12/1973 | Myren | 401/7 |
| 3,917,889 | 11/1975 | Gaffney et al. | 428/36 |
| 3,952,127 | 4/1976 | Orr | 428/255 |
| 3,957,565 | 5/1976 | Livingston et al. | 156/244 |
| 3,977,452 | 8/1976 | Wright | 150/3 |
| 4,017,949 | 4/1977 | Botvin | 28/77 |
| 4,020,208 | 4/1977 | Mercer et al. | 428/255 |
| 4,040,139 | 8/1977 | Botvin | 15/209 B |
| 4,052,238 | 10/1977 | Botvin | 156/148 |
| 4,057,449 | 11/1977 | Livingston et al. | 156/167 |
| 4,059,713 | 11/1977 | Mercer | 428/36 |
| 4,123,491 | 10/1978 | Larsen | 264/167 |
| 4,144,612 | 3/1979 | Yamaguchi | 15/208 |
| 4,152,479 | 5/1979 | Larsen | 428/224 |
| 4,154,542 | 5/1979 | Rasmason | 401/7 |
| 4,168,863 | 9/1979 | Hatcher | 300/21 |
| 4,196,490 | 4/1980 | Jonzon | 15/222 |
| 4,206,948 | 6/1980 | Shimizu | 300/21 |
| 4,287,633 | 9/1981 | Gropper | 15/209 B |

(List continued on next page.)

FOREIGN PATENT DOCUMENTS

| | | |
|---|---|---|
| 60-264235 | 12/1985 | Japan . |
| 1308904 | 7/1973 | United Kingdom . |
| 1473147 | 9/1974 | United Kingdom . |
| 2237196 | 5/1991 | United Kingdom . |

[57] ABSTRACT

*Primary Examiner*—Elizabeth M. Cole
*Attorney, Agent, or Firm*—William Scott Andes An improved washing implement which exhibits superior softness, while also retaining good resiliency and durability, is made from at least one piece of open cell polymer mesh. To achieve the improved softness, resiliency, and durability of the improved washing implement an improved open cell mesh is provided which is softer and sufficiently resilient as a result of its controlled material and cell structure parameters. In preferred embodiments, the controlled physical parameters of the open cell mesh include basis weight, cell count, node count, node length and node diameter. Optimizing the physical parameters of the mesh also results in a washing implement that absorbs and delivers increased amounts of water and cleansing product to the surface being cleaned.

18 Claims, 6 Drawing Sheets

U.S. PATENT DOCUMENTS

| | | | |
|---|---|---|---|
| 4,343,061 | 8/1982 | Hanazono | 15/244 B |
| 4,457,640 | 7/1984 | Anderson | 401/7 |
| 4,462,135 | 7/1984 | Sanford | 15/105 |
| 4,473,611 | 9/1984 | Haq | 428/198 |
| 4,651,505 | 3/1987 | Gropper | 53/456 |
| 4,710,185 | 12/1987 | Sneyd, Jr. et al. | 604/372 |
| 4,732,723 | 3/1988 | Madsen et al. | 264/147 |
| 4,769,022 | 9/1988 | Chang et al. | 604/368 |
| 4,893,371 | 1/1990 | Hartmann | 15/209 B |
| 4,911,872 | 3/1990 | Hureau et al. | 264/146 |
| 4,948,585 | 8/1990 | Schlein | 424/40 |
| 4,969,226 | 11/1990 | Seville | 15/244.4 |
| 4,986,681 | 1/1991 | Oliver | 401/7 |
| 4,993,099 | 2/1991 | Emura et al. | 15/118 |
| 5,144,744 | 9/1992 | Campagnoli | 29/446 |
| 5,187,830 | 2/1993 | Giallourakis | 15/244.3 |
| 5,229,181 | 7/1993 | Daiber et al. | 428/58 |
| 5,295,280 | 3/1994 | Hudson et al. | 15/222 |
| 5,412,830 | 5/1995 | Girardot et al. | 15/118 |
| 5,465,452 | 11/1995 | Girardot et al. | 15/210.1 |
| 5,491,864 | 2/1996 | Tuthill et al. | 15/118 |

WASHING IMPLEMENT COMPRISING AN IMPROVED OPEN CELL MESH

This is a continuation-in-part of application Ser. No. 08/631,861, filed on Apr. 12, 1996 now abandoned.

TECHNICAL FIELD

This invention relates generally to an improved implement for bathing, scrubbing, and the like, i.e., a washing implement, which comprises an improved extruded open cell mesh. More particularly, this invention relates to an improved washing implement which exhibits superior softness and lather generating, while retaining durability and resiliency.

BACKGROUND OF THE INVENTION

Polymer open cell meshes have been adapted for use as implements for scrubbing, bathing or the like, due to the relative durability and inherent roughness or scrubbing characteristics of the mesh. Also, open cell meshes improve lather of soaps in general, and more particularly, the lather of liquid soap is improved significantly when used with an implement made from an open cell mesh. Mesh roughness is generally caused by the stiffness of the multiple filaments and nodes of the open cell mesh, and cause a scratching effect or sensation in many instances. To make a scrubbing or bathing implement, the extruded open cell mesh is shaped and bound into one of a variety of configurations, e.g. a ball, tube, pad or other shape which may be ergonomically friendly to the user of the washing implement. The open cell meshes of the past were acceptable for scrubbing due to the relative stiffness of the fibers and the relatively rough texture of the nodes which bond the fibers together. However, that same stiffness and roughness or scratchiness of prior art mesh was relatively unacceptable to the general consumer when used as a personal care product.

There are a variety of methods for arranging multiple layers of extruded open cell mesh to formulate washing implements. For example, U.S. Pat. No. 5,144,744 to Campagnoli describes the manufacture of a bathing implement, in an essentially ball-like configuration, as does U.S. Pat. No. 3,343,196 to Barnhouse. Similarly, U.S. Pat. No. 4,462,135 to Sanford describes a cleaning and abrasive scrubber manufactured, in part, by the use of an open cell extruded plastic mesh. The Sanford implement is of a generally hourglass shape, although other cylindrical and tube-like structures are described. A rectangular scrubbing implement manufactured from extruded open cell mesh is described in U.S. Pat. No. 5,491,864 to Tuthill et al. However, these references do not describe or characterize a soft, yet resilient washing implement, as their open cell mesh was of the relatively rough and scratchy nature described above.

Prior open cell mesh used to manufacture washing implements has typically been manufactured in tubes through the use of counter-rotating extrusion dies which produce diamond-shaped cells. The extruded tube of mesh is then typically stretched to form hexagonal-shaped cells. The description of a general hexagonal-shaped mesh can be found in U.S. Pat. No. 4,020,208 to Mercer, et al. An example of a counter-rotating die and an extrusion mechanism is described in U.S. Pat. No. 3,957,565 to Livingston, et al. Likewise, square or rectangular webbing has been formed in sheets by two flat reciprocating dies, as shown in U.S. Pat. No. 4,152,479 to Larsen. Although the aforementioned references describe open cell meshes and methods for producing open cell meshes, these references do not describe a soft, resilient product which can be used as a washing implement. Nor do any of the references listed above define a method of characterizing the softness and resilience of a mesh.

The references described above have been concerned primarily with the strength and durability of the open cell mesh for either containing relatively heavy objects, e.g., fruit and vegetables, or for vigorous scrubbing and cleaning, e.g., of pots and pans. In order to meet the strength and durability requirements, extruded open cell mesh of the past has been manufactured from relatively stiff fibers joined together at nodes whose physical size and shape tended to make them relatively stiff and scratchy, as opposed to soft and conformable.

Hence, heretofore, there has been a continuing need for an improved washing implement comprising an extruded open cell mesh which would be soft, durable, relatively inexpensive to manufacture, an improved lather generator, and relatively resilient. More specifically, there is a need for providing an improved open cell mesh, featuring physical characteristics which could be adequately identified and characterized, so that washing implements could be reliably made from mesh exhibiting all of the aforementioned desired physical properties.

SUMMARY OF THE INVENTION

It is an object of the present invention to provide a washing implement which overcomes the problems described above. It is a further object of the present invention to provide a washing implement which is soft, yet resilient and durable enough for bathing, scrubbing and the like. It is a related object of the present invention to provide a scrubbing or bathing implement which improves lather when used with soap.

There is provided herein an improved washing implement made from an extruded open cell mesh featuring enhanced softness with resiliency structural characteristics. There is further provided herein a washing implement made from an improved extruded open cell mesh comprising a series of extruded filaments which are periodically bonded together to form repeating cells. The bonded areas between filaments are designated as "nodes", while a "cell" is defined by a plurality of filament segments with one node at each of its corners. The extruded cells of preferred embodiments are typically square, rectangular, or diamond shaped, at the time of extrusion, but the extruded mesh is often thereafter stretched to elongate the nodes, filaments, or both, to produce the desired cell geometry and strength characteristics of the resulting mesh.

The mesh can be produced through a counter-rotating extrusion die, two reciprocating flat dies, or by other known mesh forming procedures. Tubes of mesh, such as can be produced by counter-rotating extrusion dies, have a preferred node count of between about 70 and about 140, with an especially preferred range of between about 90 and about 115, the nodes being measured circumferentially around the mesh tube. A preferred cell count of a tube or sheet of mesh is between about 130 and about 260 cells/meter, with an especially preferred range of between about 170 and about 250 cells/meter, cell count being measured by a standardized test described herein. A preferred basis weight for mesh of the present invention to be utilized for washing implements is from about 5.60 grams/meter to about 10.40 grams/meter, and an especially preferred basis weight would be from about 6.00 grams/meter to about 8.50 grams/meter.

The extruded open cell mesh may be made from low-density polyethylene which is extruded at a Melt Index of between about 1.0 and about 10.0. The preferred Melt Index for extruding low-density polyethylene is between about 2.0 and about 7.0. Preferred nodes of the present invention have an approximate length, measured from opposing crotches, of from about 0.051 centimeters to about 0.241 centimeters, have an approximate thickness of from about 0.020 centimeters to about 0.038 centimeters, and have an approximate width of from about 0.038 centimeters to about 0.102 centimeters. Preferred Initial Stretch values are from about 7.0 inches to about 20.0 inches; more preferred Initial Stretch values are from about 9.0 inches to about 18 inches, and most preferred Initial Stretch values are from about 10.0 inches to about 16.0 inches. The preferred range of X/Y ratio is from about 0.25 to about 0.97; a more preferred range is from about 0.31 to about 0.95.

BRIEF DESCRIPTION OF THE DRAWINGS

While the specification concludes with claims particularly pointing out and distinctly claiming the present invention, it is believed the same will better be understood from the following description taken in conjunction with the accompanying drawings in which:

DETAILED DESCRIPTION OF THE PREFERRED EMBODIMENTS

Figure 1:
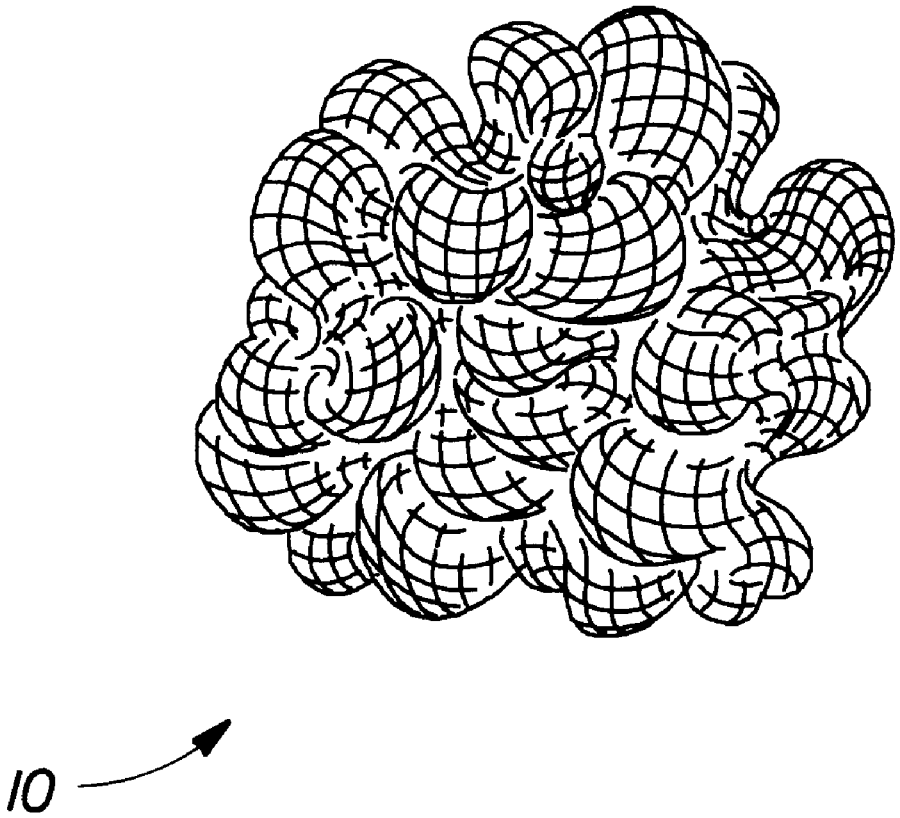
FIG. 1 illustrates an exemplary prior art hand-held ball-shaped washing implement.

Reference will now be made in detail to the present preferred embodiments of the improved washing implement comprising an open cell mesh. Examples of washing implements which can be improved by utilization of the improved open cell mesh of the present invention are illustrated in the accompanying drawings where, FIG. 1 shows a ball-like configuration for a washing implement 10 made of mesh. As will be understood, the improved open cell mesh of the present invention can be formed into washing implements of a variety of shapes and sizes.

The embodiments discussed above are described in terms of a washing implement, and more particularly, a hand-held ball-like washing implement or "puff". The term washing implement is to be broadly construed to include various applications of such an implement for bathing, exfoliating skin, scrubbing pans, dishes and the like, as well as other uses.

Manufacture of Open Cell Mesh

The process of manufacturing diamond cell and hexagonal cell mesh for use in washing implements and the like, as described above, involves the selection of an appropriate resin material which can include polyolefins, polyamides, polyesters, and other appropriate materials which produce a durable and functional mesh. Low density polyethylene (LDPE, a polyolefin), poly vinyl ethyl acetate, high density polyethylene or mixtures thereof are preferred to produce the mesh described herein, although other resin materials can be substituted provided that the resulting mesh conforms with the physical parameters defined below. Additionally, adjunct materials are commonly added to extruded mesh. Mixtures of pigments, dyes, brighteners, heavy waxes and the like are common additives to extruded mesh and are appropriate for addition to the mesh described herein.

To produce an improved open cell mesh, the selected resin is fed into an extruder by any appropriate means. Extruder and screw feed equipment for production of synthetic webs and open cell meshes are known and available in the industry. After the resin is introduced into the extruder it is melted so that it flows through extrusion channels and into the counter-rotating die, as will be discussed in greater detail below. Resin melt temperatures will vary depending upon the resin selected. The material's Melt Index is a standard parameter for correlating extrusion die temperatures to the viscosity of the extruded plastic as it flows through the die. Melt Index is defined as the viscosity of a thermoplastic polymer at a specified temperature and pressure; it is a function of the molecular weight. Specifically, Melt Index is the number of grams of such a polymer that can be forced through a 0.0825 inch orifice in 10 minutes at 190 degrees C. by a pressure of 2160 grams.

A Melt Index of from about 1.0 to about 10.0 for LDPE is preferred for manufacturing the mesh described herein for use in washing implements, and a Melt Index of from about 2.0 to about 7.0 is especially preferred. However, if alternate resin materials are used and/or other ultimate uses for the mesh are desired, an appropriate alternative Melt Index might be selected. The temperature range of operation of the extruder can vary significantly between the melt point of the resin and the temperature at which the resin degrades.

Figure 2:
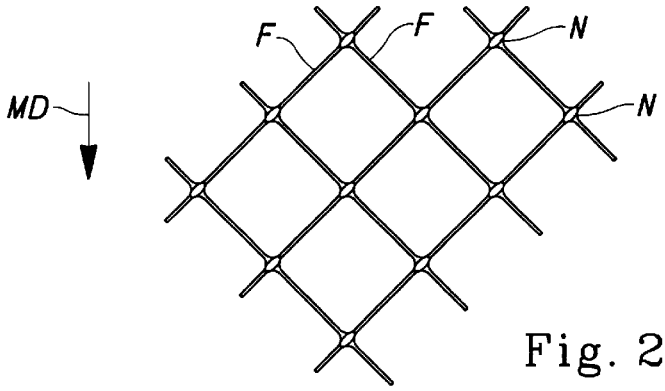
FIG. 2 illustrates an exemplary mesh section after extrusion.

The liquefied resin can then be extruded through two counter-rotating dies which are common to the industry. U.S. Pat. No. 3,957,565 to Livingston, et. al., for example, describes a process for extruding a tubular plastic netting using counter-rotating dies, such disclosure hereby incorporated herein by reference. A counter-rotating die has an inner and outer die, and both have channels cut longitudinally around their outer and inner circumferences respectively, such that when resin flows through the channels, fibers are extruded. Individual fibers, e.g., F, as seen in FIG. 2, are extruded from each channel of the inner die as well as each channel of the outer die. As the two dies are rotated in opposite directions relative to one another, the channels from the outer die align with the channels of the inner die, at predetermined intervals. The liquefied resin is thereby mixed as two channels align and the two fibers, e.g., F, as seen in FIG. 2, being extruded are bonded until the extrusion channels of the outer and inner die are again misaligned due to continued rotation. As the inner die and outer die rotate counter-directionally to each other, the process of successive alignment and misalignment of the channels of each die occurs repeatedly. The point at which the channels align and two fibers are bonded together is commonly referred to as a "node" (e.g. N of FIG. 2).

The "die diameter" is measured as the inner diameter of the outer die or the outer diameter of the inner die. These two diameters must be essentially equal to avoid stray resin from leaking between the two dies. The die diameter affects the final diameter of the tube of mesh being produced, although die diameter is only one parameter which controls the final diameter of the mesh tube. Although it is believed that a wide variety of die diameters, for example between about 2 inches and about 6 inches, are suitable for manufacturing the meshes described herein, especially preferred die diameters are in the range of between about 2½ and 3½ inches (about 6.35 and 8.90 centimeters).

The extrusion channels can likewise be varied among a variety of geometric configurations known to the art. Square, rectangular, D-shaped, quarter-moon, semi-circular, keyhole, and triangular channels are all shapes known to the art, and can be adapted to produce the mesh described herein. Quarter-moon channels are preferred for the mesh of the present invention, although other channels also provide acceptable results.

Figure 3:
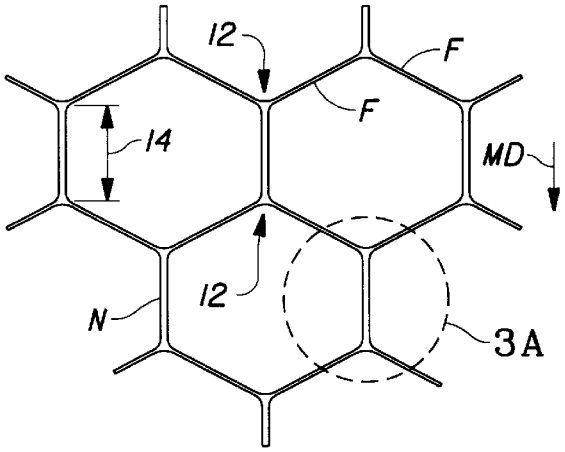
FIG. 3 illustrates an exemplary extruded mesh section after stretching.

After the tube of mesh is extruded from the counter-rotating dies, it can be characterized as having diamond-shaped cells, as shown in FIG. 2, where each of the four corners of the diamond is an individual node N and the four sides of the diamond are four, separately formed filament segments F. The tube is then pulled over a cylindrical mandrel where the longitudinal axis of the mandrel is essentially aligned with the longitudinal axis of the counter-rotating dies, i.e., the machine direction (MD as shown in FIGS. 2 and 3). The mandrel serves to stretch the web circumferentially resulting in stretching the nodes and expanding the cells. Typically the mandrel is immersed in a vat of water, oil or other quench solution, which is typically 25 degrees C. or less, which serves to cool and solidify the extruded mesh.

The mandrel can be a variety of diameters, although it will be chosen to correspond appropriately to the extrusion die diameter. The mandrel is preferably larger in diameter than the die diameter to achieve a desired stretching effect, but the mandrel must also be small enough in diameter to avoid damaging the integrity of the mesh through over-stretching. Mandrels used in conjunction with the preferred 2.5"–3.5" die diameters mentioned above might be between about 3.0" and 6.0" (about 7.62 and 15.24 cm). Mandrel diameter has been found to have a pronounced impact on the resiliency and softness of the mesh produced.

Figure 3A:
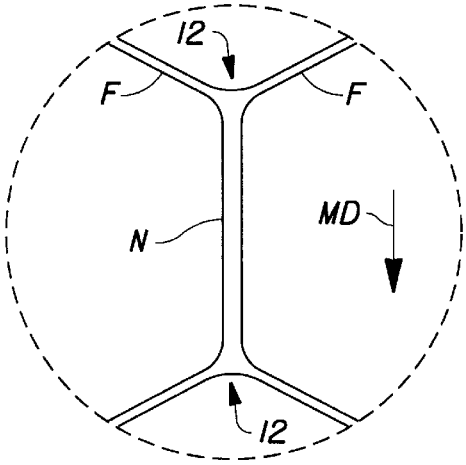
FIG. 3A illustrates an enlarged exemplary view of a node of FIG. 3 after stretching.

As the nodes of the diamond cell mesh are stretched in the machine direction, they are transformed from small, ball-like objects, e.g., N of FIG. 2, to longer, thinner filament-like nodes, e.g. N of FIGS. 3 and 3A. The cells are thereby also transformed from a diamond-like shape to hexagonal-shape wherein the nodes form two sides of the hexagon, and the four individual filament segments F form the other four sides of the hexagon. The geometric configuration of the mesh cells can also vary significantly depending on how the tube of mesh is viewed. Thus, the geometric cell descriptions are not meant to be limiting but are included for illustrative purposes only.

After passing over the mandrel, the tube is then stretched longitudinally over a rotating cylinder whose longitudinal axis is essentially perpendicular to the longitudinal axis of the tube, i.e. the longitudinal axis of the rotating cylinder is perpendicular to the machine direction (MD) of the mesh. The mesh tube is then pulled through a series of additional rotating cylinders whose longitudinal axis is perpendicular to the longitudinal axis, or the machine direction (MD) of the extruded mesh.

Preferably the mesh is taken-up faster than it is produced, which supplies the desired longitudinal, or machine direction (MD) stretching force. Typically a take-up spool is used to accumulate the finished mesh product. As should be apparent, there are a variety of process parameters (e.g., resin feed rate, die diameter, channel design, die rotation speed and the like) that affect mesh parameters such as node count, basis weight and cell count.

Although the production of open cell mesh in a tube configuration, through the use of counter-rotating dies as described, is preferred for the embodiments of the present invention, alternative processing means are known to the art. For example, U.S. Pat. No. 4,123,491 to Larsen, (the disclosure of which is hereby incorporated herein by reference), shows the production of a sheet of open cell mesh wherein the filaments produced are essentially perpendicular to one another, forming essentially rectangular cells. The resulting mesh net is preferably stretched in two directions after production, as was the case with the production of tubular mesh described above.

Yet another alternative for manufacturing extruded open cell mesh is described in U.S. Pat. No. 3,917,889 to Gaffney, et al., the disclosure of which is hereby incorporated herein by reference. The Gaffney, et al. reference describes the production of a tubular extruded mesh, wherein the filaments extruded in the machine direction are essentially perpendicular to filaments or bands of plastic material which are periodically formed transverse to the machine direction. The material extruded transverse to the machine direction can be controlled such that thin filaments or thick bands of material are formed. As was the case with the mesh manufacturing procedures described above, the tubular mesh manufactured according to the Gaffney, et al. reference is preferably stretched both circumferentially and longitudinally after extrusion.

Node Characteristics

Figure 7:
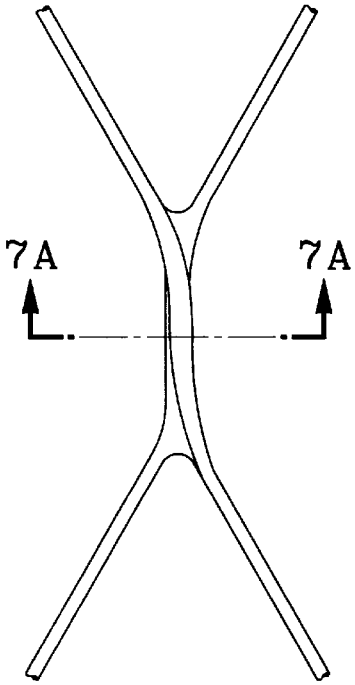
FIG. 7 illustrates an overlaid node in open cell mesh.
Figure 7A:
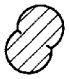
FIG. 7A illustrates a cross sectional view of the overlaid node of FIG. 7.

A key parameter when selecting a manufacturing process for the improved mesh described herein is the type of node produced. As was described above, a node is the bonded intersection between filaments. Typical prior art mesh is made with overlaid nodes (FIGS. 7 and 7A). An overlaid node can be characterized in that the filaments which join together to form the node are still distinguishable, although bonded together at the point of interface. In an overlaid node, the filaments at both ends of the node form a Y-crotch, although the filaments are still relatively distinguishable at the interface of the node. Overlaid nodes result in a mesh which has a scratchy feel.

Figure 6:
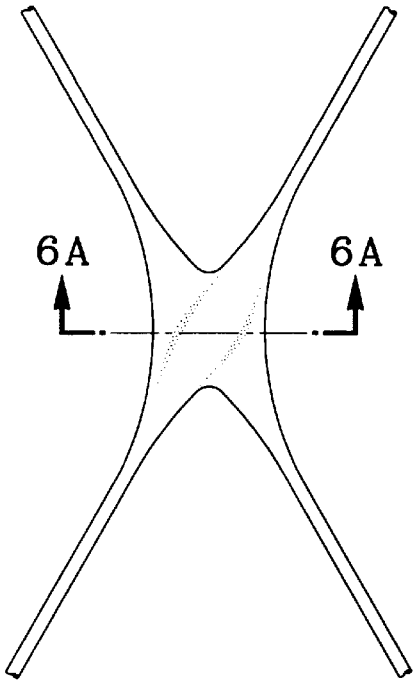
FIG. 6 illustrates a merged node in open cell mesh.
Figure 6A:
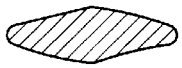
FIG. 6A illustrates a cross sectional view of the merged node of FIG. 6.

A merged node (FIGS. 6 and 6A) can be characterized by the inability after production of the mesh to easily visually distinguish the filaments which formed the node. Typically, a merged node resembles a wide filament segment. A merged node can have a "ball-like" appearance, similar to that shown by N of FIG. 2, or can be stretched subsequent to formation to have the appearance of node N of FIGS. 3 and 3A. In either case, at each end of the node there is a Y-crotch, configuration, e.g., 12 of FIGS. 3 and 3A, at the point where the filament segments F branch off the node. For both overlaid and merged nodes, node length 14, as shown in FIG. 3, is defined as the distance from the center of the crotch of one Y-shape to the center of the crotch of the Y-shape at the opposite end of the node. The combination of merged nodes with the other physical characteristics specified herein, results in a mesh with a consumer preferred range of softness and resiliency, specifically when used in cleansing implements.

Node diameter is not easily measured because nodes rarely have uniform cross-sectional diameters. However, an "effective diameter" can be defined as the average between a node's smallest diameter and its largest diameter measured near the midpoint between the Y-crotches at each end. As should be apparent, the measurement of node length and node diameter are to be compared at the conclusion of the extrusion process, (i.e., after the material has been through the stretching steps). Preferred nodes of mesh to be used for washing implements have an approximate length, measured from opposing crotches, of from about 0.051 centimeters to about 0.241 centimeters, and the nodes have an effective diameter of from about 0.030 centimeters to about 0.071 centimeters. The nodes can also be characterized as having a thickness ranging from about 0.020 centimeters to about 0.038 centimeters, and a width of from about 0.038 centimeters to about 0.102 centimeters.

Other Physical Parameters

Figure 5:
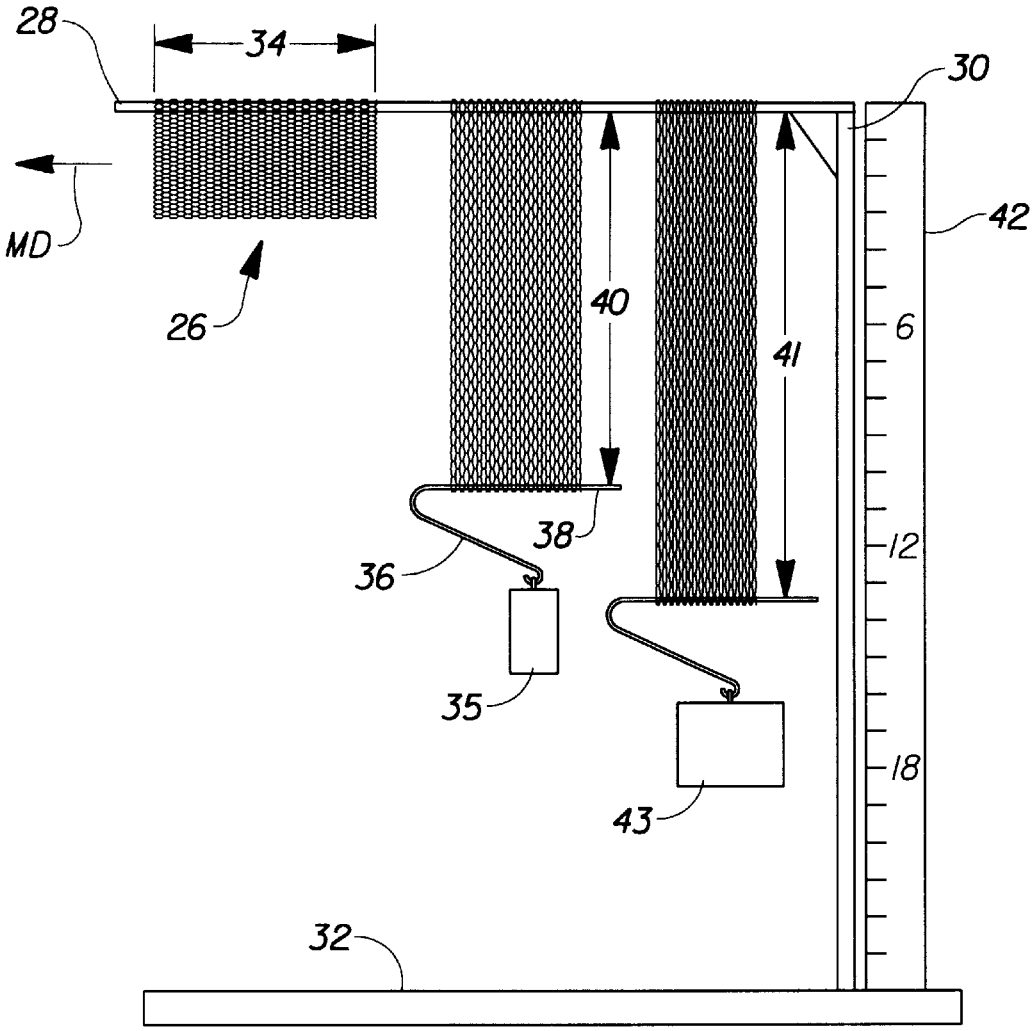
FIG. 5 is a schematic illustration of testing procedures for measuring an open cell mesh's resistance to an applied weight, useful in characterizing the open cell mesh made according to the subject invention.

As will be apparent, the measurement of flexibility of a mesh is a critical characterization of the softness and conformability of a mesh. It has been determined that a standardized test of mesh flexibility can be performed as described herein and as depicted in FIG. 5. The resulting measurement of flexibility is defined herein as Initial Stretch. As schematically illustrated in FIG. 5, the procedure for determining Initial Stretch begins by hanging a mesh tube 26 from a test stand horizontal arm 28, which in turn is supported by a vertical support member 30 and which is in turn attached to a test stand base 32. The tube of mesh is hung from arm 28 so that its machine direction (MD) is parallel to arm 28.

As was described above, when the open cell mesh is extruded from a counter-rotating die, the mesh is formed in a tube. If a sheet of mesh is produced, as was described in the Larsen 4,123,491 patent, the sheet must be formed into a tube by binding the sheet's edges securely together prior to performing the Initial Stretch measurement. The tube of mesh 26 for testing should be 6.0 inches (15.24 centimeters) in length, as indicated by length 34. Six inches was chosen, along with a 50.0 gram weight 35, as an arbitrary standard for making the measurement. As will be apparent, other standard conditions could have been chosen; however, in order to compare normalized Initial Stretch values for different meshes, it is preferred that the standard conditions chosen and described herein are followed uniformly.

As is illustrated in FIG. 5, a standardized weight is suspended from a weight support member 36, which has a weight support horizontal arm 38 placed through and hung from the mesh tube 26. It is critical that the total combined weight of the weight support member 36 and the standardized weight equal 50 grams. Distance 40 illustrates the Initial Stretch, and is the distance which mesh tube 26 stretches immediately after the weight has been suspended from mesh tube 26. A linear scale 42 is preferably used to measure distance 40. For mesh of the present invention it is generally preferred to have a Initial Stretch value of from about 7.0 inches (17.8 cm) to about 20.0 inches (50.8 cm), more preferred to have an Initial Stretch value of from about 9.0 inches (22.9 cm) to about 18.0 inches (45.7 cm), and most preferred to have an Initial Stretch value of from about 10.0 inches (25.4 cm) to about 16.0 inches (40.6 cm).

The resilient property of the open cell mesh can be measured by suspending a larger standardized weight 43 (i.e., 250 grams as shown in FIG. 5) and substracting distance 40 from distance 41. It is critical that the total combined weight of the weight support member and the larger standardized weight equal 250 grams. The result is directly proportional to the level of resilience in the material.

Figure 4:
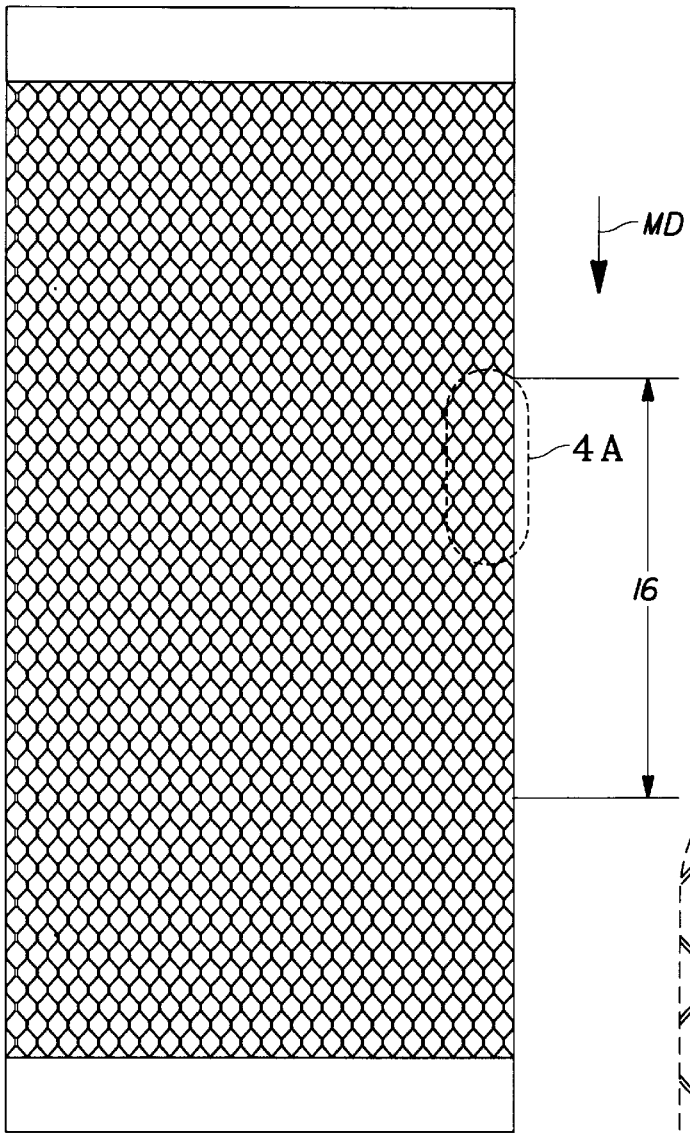
FIG. 4 illustrates a mesh section used for counting cells in an open cell mesh.
Figure 4A:
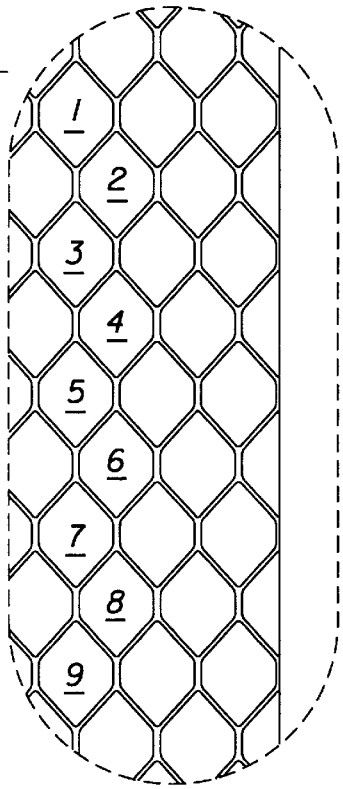
FIG. 4A illustrates an enlarged view of a portion of the mesh of FIG. 4.

FIG. 4 illustrates a standardized method for counting cells; a staggered row of cells are counted out in the machine direction of the tube of mesh, as shown in FIG. 4A. A rigid frame may be used to secure a section of mesh so that it is held firmly in place. The mesh is pulled taught along its machine direction (MD). When the mesh is taught, a segment 16 is marked off, for example with a felt tipped marker. This segment can be any length, but preferably at least a foot long for maximum accuracy in making the measurement. For example, one may choose to mark off a segment that is 30 centimeters in length; this is fine, so long as the final count is converted to cells per meter.

After the mesh section 16 is marked off, the mesh section may be pulled in a direction transverse to the machine direction; the idea here is to open up the cells enough so that they may be comfortably counted. FIG. 4A illustrates an enlarged portion of the mesh, with numbers 1 through 9 indicating individual cells. As can be seen in FIG. 4A, one cell in each row is counted down the length of the marked off portion of the tube; every other row is vertically aligned due to the diamond or hexagonal cell configuration. This yields the cells per unit length.

Characterizing the improved mesh in the cross-machine direction is accomplished by counting a string of nodes along a line around the circumference of the tube of mesh. This method is universal to tubes or flat sheets of mesh and simply comprises selecting a linear row of nodes and counting them. As should be apparent, any row of nodes will contain an identical number of nodes; this is dependent on the extrusion die configuration. Preferred ranges for node count for mesh to be used for washing implements are between about 70 and about 140. Especially preferred ranges are between about 90 and about 115.

Basis weight is another empirical measurement which can be performed on any tube or sheet of extruded open cell mesh. A length of mesh, e.g., 30 centimeters, is measured in the machine direction, then is cut off and weighed. The basis weight is converted to and tracked in units of grams per meter. The preferred basis weight for mesh of the subject invention to be used for washing implements is from about 5.60 grams per meter to about 10.40 grams per meter, with an especially preferred range of from about 6.00 grams per meter to about 8.50 grams per meter.

Durability, Absorptive/Dispersive Capacity, Cell Geometry

Through the course of experimentation we have discovered that netting materials that are highly flexible under a very low level of stress are perceived by consumers as having a much softer feel on the skin. Further, when this highly flexible netting is formed into a bathing implement, the resulting implement significantly improves consumer preference ratings for both the cleansing implement as well as the cleansing product it is used with.

The improved consumer ratings are directly attributable to the more flexible netting material's ability to conform easily to body contours, and to more evenly distribute applied forces thus reducing abrasion. The result is an improved consumer perception of "softness", and resiliency.

The benefits of the improved mesh of this invention when used as a washing implement or the like, include improved consumer acceptability, and improved softness when the washing implement is rubbed against human skin. Improved lathering is also an important improvement of bathing implements made from mesh of the present invention. Lather is improved when the soap is in bar form, liquid form, and most importantly gel form. When mesh is used in the production of washing implements, tactile softness, i.e., the feel of the mesh as it contacts human skin, is an important criteria. However, resiliency is also an important physical criteria. It may be intuitive that producing a softer mesh would result in a relatively limp mesh which may not retain the desired shape for the washing implement, i.e., stiffness sacrificed in favor of softness. However, mesh of the present invention has been found to have the unique properties of being both soft and relatively resilient, i.e. the mesh is able to retain its shape when used as a washing implement. A washing implement which is soft but does not conform to the skin or object being scrubbed (i.e., the implement is limp), or is not resilient, is generally not acceptable to consumers. Therefore, the improved open cell mesh described herein provides a material which is both soft to the touch and, when used to manufacture washing implements, is resilient enough to provide the necessary conformability which is preferred by consumers.

The present implement achieves softness, in part through a lower mesh basis weight, while at least maintaining durability of the implement, in comparison to prior art implements. This means that the present implement retains its shape and size over time with continued use by the consumer; prior art implements tend to expand and grow limp and unwieldy with continued use. We have found that this quality is due to the degree of cell openness, or the overall cell geometry, which we have quantified in terms of a ratio (see FIG. 8). When the net extrusion process is known, the ratio can be measured directly. When the extrusion process is unknown, measurement of the cell angle in the mesh can be used to accurately measure this ratio.

Figure 8:
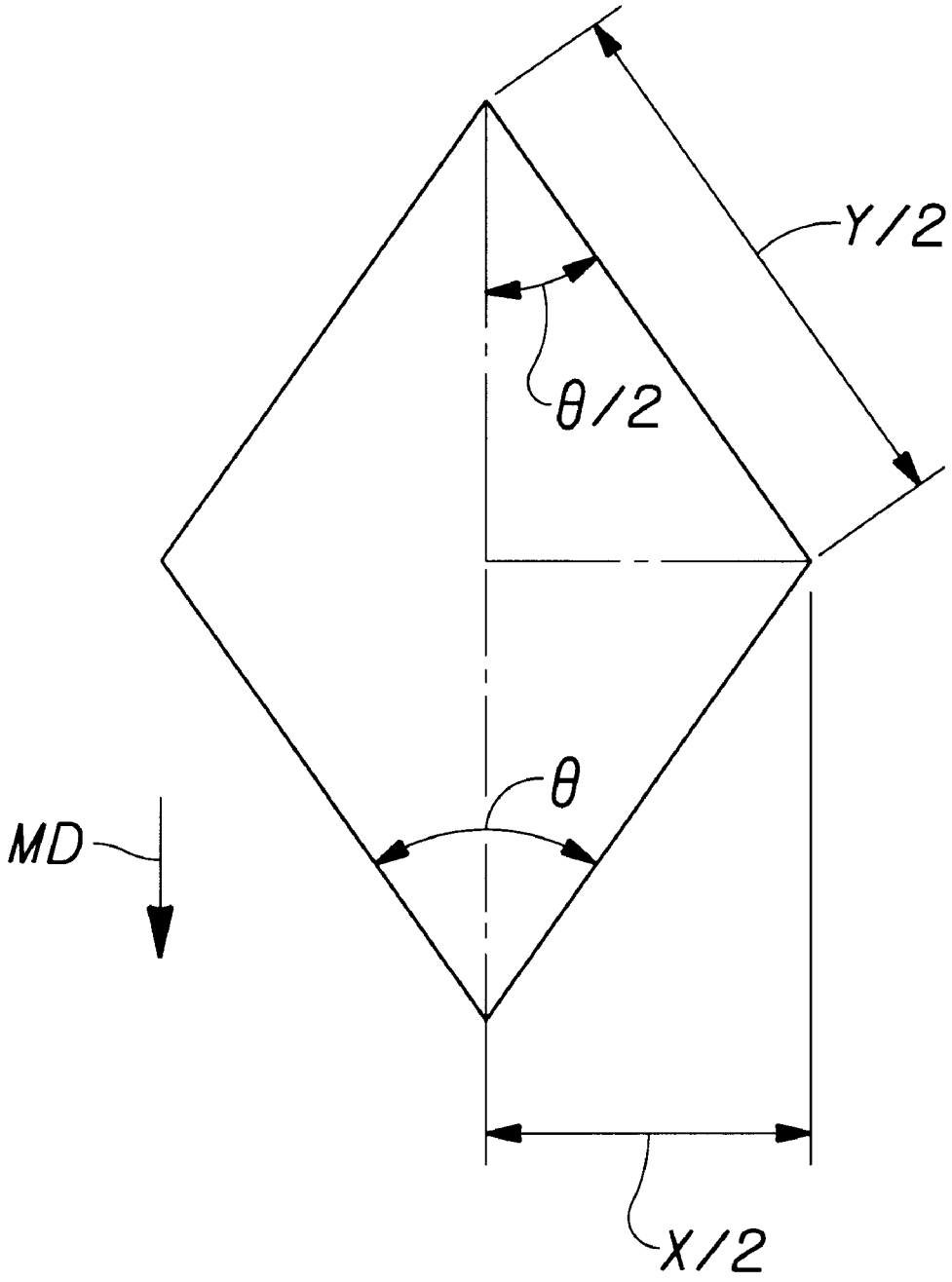
FIG. 8 illustrates cell geometry determination.

Prior art implements are typically made with cells that are relatively closed, or have a very small cell angle, ø, as depicted in FIG. 8. During use, these small-angled cells relax and open which causes growth and deterioration of the implement's shape. If the cells in the raw mesh are within a certain range of openness before the mesh is made into an implement, the implement will not tend to grow and lose its shape during use, and will last much longer. We have found that the preferred range of ø is about 29 degrees to about 151 degrees, which corresponds to an X/Y ratio of from about 0.25 to about 0.97. A more preferred range of X/Y is from about 0.31 to about 0.95.

Referring to FIG. 8, the X/Y ratio is equal to the sin (ø/2), where ø is the open angle of a given cell. Y is the length of one cell as measured when the mesh is pulled taught in the machine direction. Y/2 can be determined through the measurements made when determining cell count, supra; Y/2 is equal to the length of mesh measured off for the cell count calculation divided by the number of cells counted. Recall that cells are counted in a staggered fashion, which accounts for a result of Y/2 rather than Y.

X/2 is half the width of a cell, as shown in FIG. 8, as measured when the tube of mesh is in a relaxed state. X/2 is equal to "pi times the relaxed tube diameter", divided by "two times the node count". Pi times the tube diameter is equal to the tube circumference, and two times the node count is equal to two times the number of cells around the tube circumference; the result is half the overall width of a single cell.

Cell count and node count are easily determined for any puff or net material as described, supra. Tube diameter and ø are not easily measurable, which gives rise to the need for the X/Y ratio. The following two examples will better illustrate cell geometry determination:

Example 1—Process for Manufacture of Netting is Known

The tube diameter is known from the netting process. It is either the die diameter if no mandrel is subsequently used, or the mandrel diameter if the tube is stretched over a mandrel. Because cell count, node count, and tube diameter are all known, ø, X, and Y can all be calculated, and therefore X/Y can be calculated.

Example 2—Process for Manufacture of Netting is Unknown

Here, only cell count and node count can be easily determined. The relaxed cell angle protocol (described infra) can be used to approximate the X/Y ratio. Based on the open angle calculated from the relaxed cell angle protocol, the X/Y ratio can be calculated geometrically.

The objective of the relaxed cell angle protocol is to estimate the cell angle as it exists as the netting tube comes off the manufacturing process. This method becomes necessary when an implement is made of netting from an unknown manufacturing process, and the netting comes from a disassembled implement and is therefore folded and irregular in shape. The objective here is to relax the netting and return it to the form it was in prior to deformation into an implement shape. Measurement of cell angles taken after using this method correlate well with measurement of cell angles taken from netting straight off the manufacturing process.

The equipment necessary to perform this method is as follows: a hot plate, a stir bar, a thermometer or pyrometer, a flat spatula, and a wide vessel. Using a hot plate, heat water in the vessel to 175 degrees Fahrenheit, and agitate the water with the stir bar. This temperature is below the glass transition point of low density polyethylene, which is the typical polymer of choice for bathing implements of this type; this temperature therefore does not alter the physical state of the netting beyond that of its original state as manufactured.

Take the netting from a disassembled implement, and cut a 2 inch length of tube across the machine direction of the tubing. Cut this circle of netting into two semicircles, and lay them out flat to form two rectangles 2 inches by ½ the tube circumference in area. Immerse net samples into water bath for 10 seconds. Remove the samples from the water bath with the spatula. After cooling, measure the cell angle as shown in FIG. 8; a preferred method of measurement is to measure at least five regions of the sample and average them. Any of various angle measurement techniques may be used.

When the range of cell angle specified above is combined with a mesh basis weight of from about 5.60 grams per meter to about 10.40 grams per meter, the relationship between softness and durability of the implement is optimized.

The ability of the present implement to absorb and deliver water and cleansing lather has also been improved. Because of its lower basis weight, the present implement contains a longer tube of mesh than prior art implements, when comparing implements of equal weight. This additional length of mesh, in addition to the openness of cells within the mesh, provides for more open space within individual cells and more individual cells. The result is an increased capacity to pick up water and lather, and then deliver the increased amounts of water and lather to the consumer's body. The preferred range of basis weight for improved absorption and delivery is from about 5.60 grams per meter to about 8.50 grams per meter, with a more preferred range being from about 6.00 grams per meter to about 8.00 grams per meter.

The following protocol was developed to measure the mass of cleansing product and water solution that is absorbed by the present cleansing implement, the mass of cleansing product and water dispersed by the implement, and the volume of lather dispersed by the implement during use. At lower basis weights, more lather is generated per the following test method. The test method demonstrates the ability of an implement to deliver the absorbed product as consumer noticed lather.

This absorption and dispersion protocol was developed to determine if different implements have different capacities to absorb and then disperse product and water. The test is designed to closely pattern consumer use: the first step is to saturate the implement with water and product and allow excess to run off. Product is mixed with the water in order to prepare a controlled surfactant solution. The use of this surfactant solution enables each implement to retain an amount of product directly related to its absorbtive capacity instead of using some fixed amount which biases implements of different size. The surfactant solution is kept at a controlled temperature to simulate actual shower water. The dispersion section of the test measures the amount of product, water and lather that leave the puff during a controlled scrubbing motion for a controlled time, much like the consumer would perform in use.

The necessary equipment includes an 800 mL beaker, a hot plate, a stirrer, a water hardness kit (if performing the test with 14 grain water), and a standard medium-sized Rubbermaid bath mat. The protocol is as follows:

1. Prepare the surfactant solution: add 70 grams of product to 630 mL of water (either de-ionized/distilled or 14 grain hardness water).

2. Using a hot plate and stirrer, bring water temperature to 95 degrees F., and stir for 5 minutes prior to testing. Keep stirrer on for duration of test.

3. Weigh dry implement. Submerge implement for 10 seconds in solution to saturation point.

4. Remove implement from solution, and suspend implement for 15 seconds to allow excess to drip off.

5. Weigh implement (this is reported as absorption mass).

6. Place implement on rubber testing surface (bath mat). Rub implement back and forth using a controlled amount of compression and stroke length (18 inches). Each back and forth motion should take approximately one second. Repeat the motion 60 times (about 1 minute).

7. Weigh implement (this is reported as dispersion mass).

8. Collect accumulated lather using teflon spatula and place it in 800 mL beaker. Level lather and record volume filled in beaker (this is reported as lather volume).

9. Rinse and hang implement to dry.

The protocol methods described above are based on a netting material of polyethylene. Naturally, if other materials are used, variables in the protocol like temperature will need to be adjusted accordingly. One skilled in the art would find such adjustments to these protocol obvious if other materials are used.

Having showed and described the preferred embodiments of the present invention, further adaptation of the improved open cell mesh and resulting washing implement can be accomplished by appropriate modifications by one of ordinary skill in the art without departing from the scope of the present invention. A number of alternatives and modifications have been described herein and others will be apparent to those skilled in the art. For example, specific methods of manufacturing washing implements from open cell mesh have been described although other manufacturing processes can be used to produce the desired implement. Likewise, broad ranges for the physically measurable parameters have been disclosed for the inventive open cell mesh as preferred embodiments of the present invention, yet within certain limits, the physical parameters of the open cell mesh can be varied to produce other preferred embodiments of improved mesh of the present invention as desired. Accordingly, the scope of the present invention should be considered in terms of the following claims and is understood not be limited to the details of the structures and methods shown and described in the specification and in the drawings.

We claim:

1. A washing implement comprising extruded open cell mesh, the open cell mesh having a basis weight of from about 5.60 grams per meter to about 10.40 grams per meter and an X/Y ratio of from about 0.25 to about 0.97, the mesh being shaped and bound into a hand-held implement suitable for cleansing applications.

2. The washing implement according to claim 1, wherein the range of X/Y is from about 0.31 to about 0.95.

3. The washing implement according to claim 1, wherein the range of X/Y is from about 0.25 to about 0.71.

4. The washing implement according to claim 1, wherein the range of X/Y is from about 0.31 to about 0.60.

5. The washing implement according to claim 1, wherein the range of basis weight is from about 6.00 grams per meter to about 8.50 grams per meter.

6. The washing implement according to claim 5, wherein the range of X/Y is from about 0.31 to about 0.95.

7. The washing implement according to claim 5, wherein the range of X/Y is from about 0.25 to about 0.71.

8. The washing implement according to claim 5, wherein the range of X/Y is from about 0.31 to about 0.60.

9. A washing implement comprising:

extruded open cell mesh, having a basis weight, a plurality of nodes, and a plurality of cells, the mesh further comprising;

a) a node count ranging from about 70 to about 140;

b) a node length ranging from about 0.051 centimeters to about 0.241 centimeters;

c) a node width ranging from about 0.038 centimeters to about 0.102 centimeters;

d) a node thickness ranging from about 0.020 centimeters to about 0.038 centimeters;

e) a cell count ranging from about 130 cells per meter to about 260 cells per meter;

f) a basis weight ranging from about 5.60 grams per meter to about 10.40 grams per meter;

g) an X/Y ratio of from about 0.25 to about 0.97;

the mesh being shaped and bound into a hand held implement suitable for cleansing applications.

10. A washing implement according to claim 9, wherein the X/Y ratio is from about 0.31 to about 0.95.

11. A washing implement according to claim 9, wherein the mesh comprises low density polyethylene, poly vinyl ethyl acetate, high density polyethylene, ethylene vinyl acetate, or mixtures thereof.

12. A washing implement according to claim 9, wherein the mesh is low density polyethylene extruded at a Melt Index of between about 1 gms/10 mins and about 10 gms/10 mins.

13. A washing implement according to claim 12, wherein the low density polyethylene is extruded at a Melt Index of between about 2 gms/10 mins and about 7 gms/10 mins.

14. The washing implement according to claim 9, comprising:

a) a node count ranging from about 90 to about 115;

b) a node length ranging from about 0.051 centimeters to about 0.241 centimeters;

c) a node thickness ranging from about 0.020 centimeters to about 0.038 centimeters;

d) a node width ranging from about 0.038 centimeters to about 0.102 centimeters;

e) a cell count ranging from about 130 cells per meter to about 260 cells per meter; and f) a basis weight ranging from about 6.00 grams per meter to about 8.65 grams per meter;

g) an X/Y ratio of from about 0.25 to about 0.71.

15. The washing implement according to claim 14, wherein the X/Y ratio is from about 0.31 to about 0.60.

16. The washing implement according to claim 15, wherein the cell count ranges from about 170 cells per meter to about 250 cells per meter.

17. A washing implement according to claim 16, wherein the mesh is low density polyethylene extruded at a Melt Index of between about 1 gms/10 mins and about 10 gms/10 mins.

18. A washing implement according to claim 17, wherein the low density polyethylene is extruded at a Melt Index of between about 2 gms/10 mins and about 7 gms/10 mins.

* * * * *